US009934719B2

(12) United States Patent
Wang et al.

(10) Patent No.: US 9,934,719 B2
(45) Date of Patent: Apr. 3, 2018

(54) ELECTROLUMINESCENT DISPLAY PANEL AND DRIVING METHOD THEREOF

(71) Applicant: AU Optronics Corporation, Hsin-Chu (TW)

(72) Inventors: Tsang-Hong Wang, Hsin-Chu (TW); Chee-Wai Lau, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 15/384,408

(22) Filed: Dec. 20, 2016

(65) Prior Publication Data

US 2017/0103700 A1 Apr. 13, 2017

Related U.S. Application Data

(63) Continuation of application No. 13/935,565, filed on Jul. 5, 2013, now abandoned.

(30) Foreign Application Priority Data

Oct. 22, 2012 (TW) ..... 101138904 A

(51) Int. Cl.
*G09G 3/30* (2006.01)

(52) U.S. Cl.
CPC ..... *G09G 3/30* (2013.01); *G09G 2300/0452* (2013.01); *G09G 2310/0251* (2013.01);
(Continued)

(58) Field of Classification Search
None
See application file for complete search history.

(56) References Cited

U.S. PATENT DOCUMENTS 6,025,935 A 2/2000 Tseng
6,333,729 B1 12/2001 Ha
(Continued)

FOREIGN PATENT DOCUMENTS

CN 1728222 A 2/2006
CN 102648437 A 8/2012
EP 2490068 A1 8/2012

OTHER PUBLICATIONS

Non-Final Office Action issued in U.S. Appl. No. 13/935,565, filed Jul. 5, 2013, dated Apr. 23, 2015
(Continued)

*Primary Examiner* — Jennifer Mehmood
*Assistant Examiner* — Parul Gupta
(74) *Attorney, Agent, or Firm* — McClure, Qualey & Rodack, LLP

(57) ABSTRACT

An electroluminescent display panel includes a plurality of sub-pixels; a plurality of scan lines, each of the scan lines being electrically connected to a first row of sub-pixels and a second row of sub-pixels of two adjacent rows; a plurality of first data lines electrically connected to the first rows of sub-pixels of corresponding columns respectively; a plurality of second data lines electrically connected to the second rows of sub-pixels of corresponding columns respectively; a scan driving unit for outputting a plurality of scanning signals; and a data driving unit for outputting a plurality of dada signals; wherein the scanning signals sequentially turn on two adjacent rows of sub-pixels via the scan lines, the data signals on the first data lines charge the first rows of sub-pixels of the corresponding columns, and the data signals on the second data lines charge the second rows of sub-pixels of the corresponding columns.

14 Claims, 14 Drawing Sheets

(52) U.S. Cl.
CPC ..... *G09G 2310/0267* (2013.01); *G09G 2310/0275* (2013.01); *G09G 2310/0297* (2013.01); *G09G 2320/0233* (2013.01)

(56) References Cited

U.S. PATENT DOCUMENTS

| | | | | |
|---|---|---|---|---|
| 6,809,719 | B2 | 10/2004 | Wu | |
| 2003/0146893 | A1 | 8/2003 | Sawabe | |
| 2006/0001617 | A1 | 1/2006 | Shin | |
| 2006/0107146 | A1* | 5/2006 | Kim | G09G 3/3233 714/727 |
| 2009/0189881 | A1* | 7/2009 | Ooishi | G09G 3/20 345/211 |
| 2011/0298694 | A1 | 12/2011 | Nieh | |
| 2012/0200481 | A1 | 8/2012 | Tsubata | |
| 2012/0229483 | A1 | 9/2012 | Li et al. | |

OTHER PUBLICATIONS

Final Office Action issued in U.S. Appl. No. 13/935,565, filed Jul. 5, 2013, dated Oct. 7, 2015.
Non-Final Office Action issued in U.S. Appl. No. 13/935,565, filed Jul. 5, 2013, dated Apr. 4, 2016.
Final Office Action issued in U.S. Appl. No. 13/935,565, filed Jul. 5, 2013, dated Aug. 26, 2016.

* cited by examiner

ELECTROLUMINESCENT DISPLAY PANEL AND DRIVING METHOD THEREOF

This application is a continuation application of co-pending U.S. application Ser. No. 13/935,565, filed Jul. 5, 2013, which claims the benefit of Taiwan application Serial No. 101138904, filed Oct. 22, 2012, the disclosure of which is incorporated by reference herein in its entirety.

BACKGROUND

1. Technical Field

The present disclosure relates to an electroluminescent display panel, and more particularly, to an electroluminescent display panel capable of improving image uniformity.

2. Description of the Prior Art

An electroluminescent display panel is a display panel configured to control brightness of light emitting elements of sub-pixels for displaying images. When component characteristics of the sub-pixels of the electroluminescent display panel are not uniform, a mura effect may easily occur, so as to affect quality of the displayed images.

Please refer to FIG. 1. FIG. 1 is a diagram showing a pixel of an electroluminescent display panel of the prior art. In order to prevent the mura effect generated due to nonuniformity of the component characteristics of the sub-pixels of the electroluminescent display panel, the pixel of the electroluminescent display panel of the prior art is arranged as shown in FIG. 1, in order to eliminate influence from different threshold voltage drops of transistors.

However, according to the above arrangement, if time for charging the pixel by data signals is not long enough, a current I flowing through a light emitting element 100 can not reach a predetermined value, such that the pixel is not able to display correct images.

SUMMARY OF THE INVENTION

The present disclosure provides an electroluminescent display panel, which comprises a plurality of pixels respectively comprising a plurality of sub-pixels; a plurality of scan lines, each of the scan lines being electrically connected to a first row of sub-pixels and a second row of sub-pixels of two adjacent rows of sub-pixels; a plurality of first data lines, each of the first data lines being electrically connected to the first rows of sub-pixels of a corresponding column of sub-pixels; a plurality of second data lines, each of the second data lines being electrically connected to the second rows of sub-pixels of a corresponding column of sub-pixels; a scan driving unit coupled to the plurality of scan lines for outputting a plurality of scanning signals; and a data driving unit coupled to the first data lines and the second data lines for outputting a plurality of data signals. Wherein the scanning signals sequentially turn on two adjacent rows of sub-pixels via the scan lines, the data signals on the first data lines charge the first rows of sub-pixels of the corresponding columns of sub-pixels, and the data signals on the second data lines charge the second rows of sub-pixels of the corresponding columns of sub-pixels.

The present disclosure further provides a driving method of an electroluminescent display panel, the electroluminescent display panel comprises a plurality of pixels, a plurality of scan lines, a plurality of first data lines, and a plurality of second data lines, each of the scan lines being electrically connected to a first row of sub-pixels and a second row of sub-pixels of two adjacent rows of sub-pixels, each of the first data lines being electrically connected to the first rows of sub-pixels of a corresponding column of sub-pixels, each of the second data lines being electrically connected to the second rows of sub-pixels of a corresponding column of sub-pixels; the driving method comprises applying a plurality of scanning signals to the plurality of scan lines for sequentially turning on two adjacent rows of sub-pixels during a scanning period, the plurality of scanning signals being not overlapped with each other; and applying a plurality of data signals for charging a first row of sub-pixels of turned-on two adjacent rows of sub-pixels via the first data lines, and charging a second row of sub-pixels of the turned-on two adjacent rows of sub-pixels via the second data lines.

These and other objectives of the present disclosure will no doubt become obvious to those of ordinary skill in the art after reading the following detailed description of the preferred embodiment that is illustrated in the various figures and drawings.

DETAILED DESCRIPTION

Figure 1:
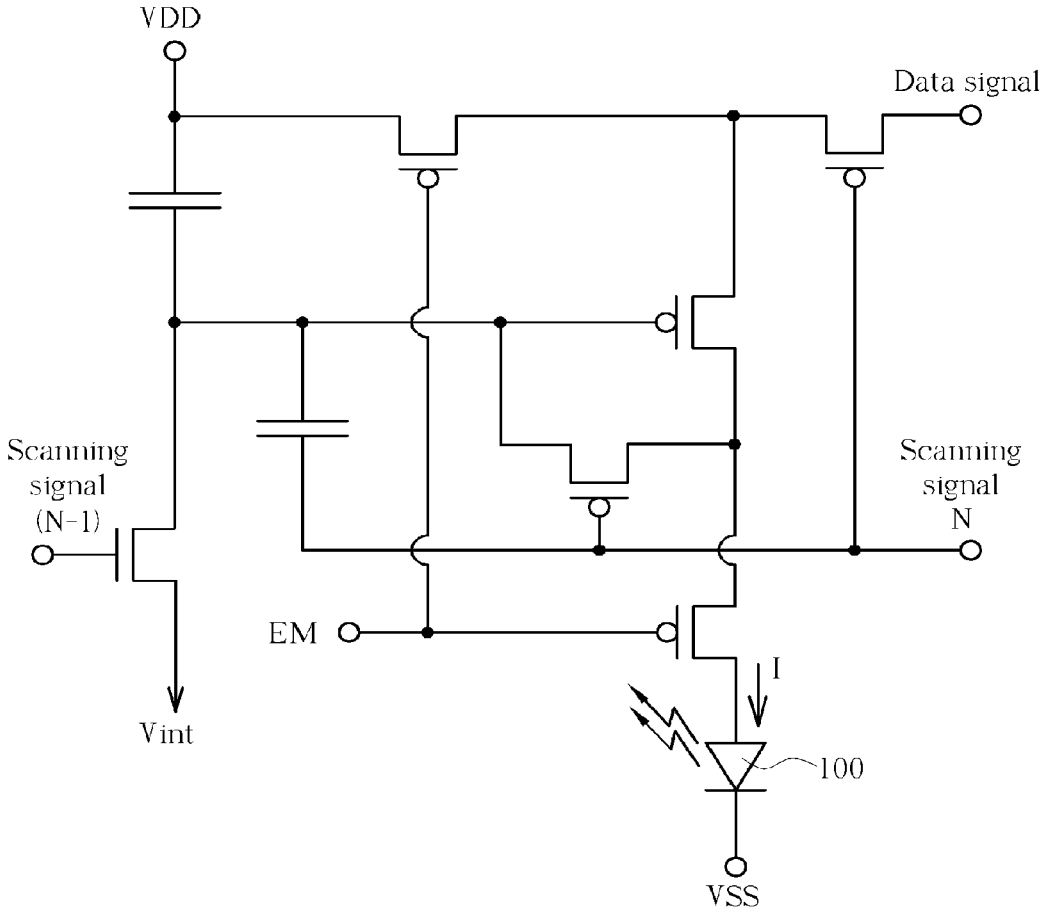
FIG. 1 PRIOR ART
FIG. 1 is a diagram showing a pixel of an electroluminescent display panel of the prior art.
Figure 2:
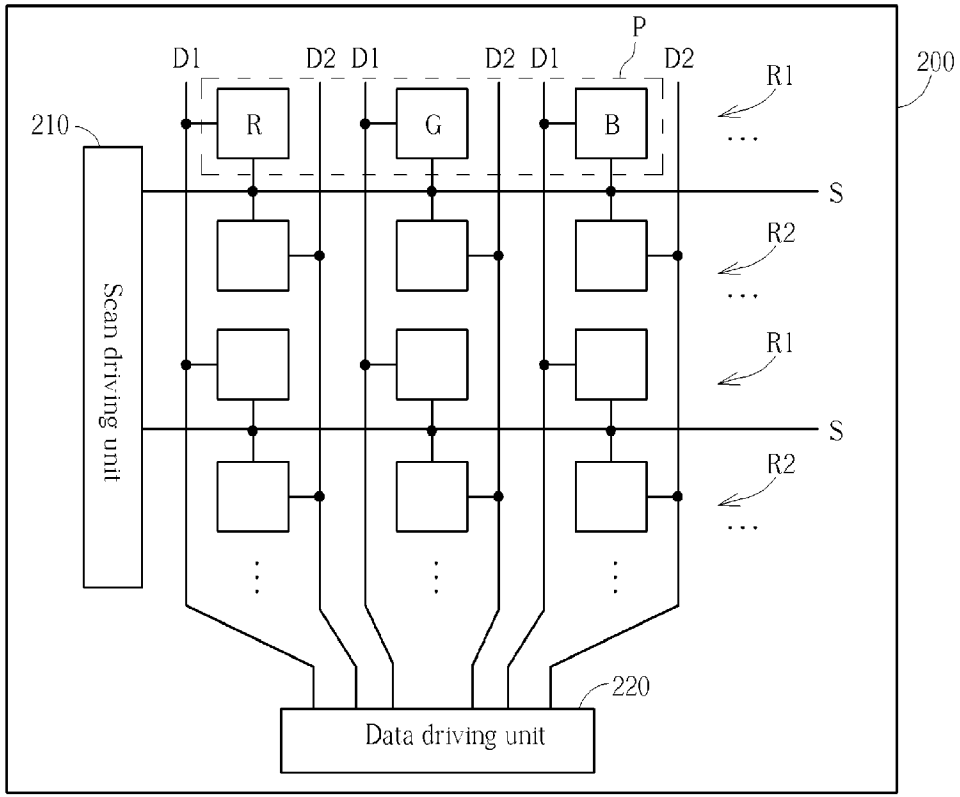
FIG. 2 is a diagram showing a first embodiment of an electroluminescent display panel of the present disclosure.

Please refer to FIG. 2. FIG. 2 is a diagram showing a first embodiment of an electroluminescent display panel of the present disclosure. As shown in FIG. 2, the electroluminescent display panel 200 of the present disclosure comprises a plurality of pixels P, a plurality of scan lines S, a plurality of first data lines D1, a plurality of second data lines D2, a scan driving unit 210, and a data driving unit 220. Each of the pixels P comprises a plurality of sub-pixels, such as red sub-pixels R, green sub-pixels G and blue sub-pixels B. Pixel rendering of each of the sub-pixels R, B can be like the pixel rendering (such as arrangement of transistors and capacitors) shown in FIG. 1, or other pixel rendering for eliminating influence from different threshold voltage drops of transistors. Each of the scan lines S is electrically connected to a first row R1 of sub-pixels and a second row R2 of sub-pixels of two adjacent rows of sub-pixels. Each of the first data lines D1 is electrically connected to the first rows R1 of sub-pixels of a corresponding column of sub-pixels. Each of the second data lines D2 is electrically connected to the second rows R2 of sub-pixels of a corresponding column of sub-pixels. The scan driving unit 210 is coupled to the plurality of scan lines S for outputting a plurality of scanning signals. The data driving unit is coupled to the first data lines D1 and the second data lines D2 for outputting a plurality of data signals.

According to the above arrangement, a number of the scan lines S is half of a number of the rows of sub-pixels, and a total number of the first and second data lines D1, D2 is twice the number of the columns of the sub-pixels. When the scan driving unit 210 outputs the scanning signals (the scanning signals are not overlapped with each other) to the scan lines S for sequentially turning on two adjacent rows of sub-pixels, the data signals outputted by the data driving unit 220 are capable of charging the first row R1 of sub-pixels of the turned-on two adjacent rows of sub-pixels via the first data lines D1, and charging the second row R2 of sub-pixels of the turned-on two adjacent rows of sub-pixels via the second data lines D2 simultaneously. Since the data driving unit 220 can charge two rows of sub-pixels at a same time, a scanning period of each of the scan lines (time for turning two adjacent rows of sub-pixels) can be twice compared to time for charging one row of sub-pixels once. Therefore, the sub-pixels have enough time for charging, so as to display correct images.

Figure 3:
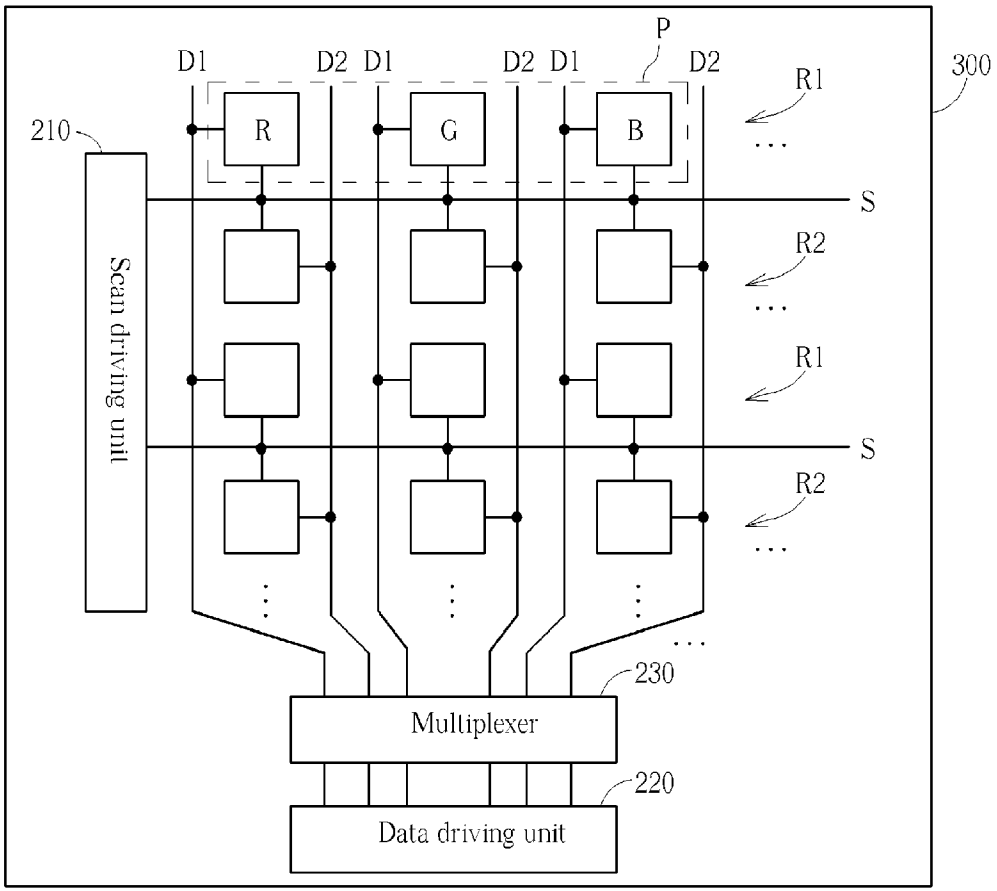
FIG. 3 is a diagram showing a second embodiment of an electroluminescent display panel of the present disclosure.

Please refer to FIG. 3. FIG. 3 is a diagram showing a second embodiment of an electroluminescent display panel of the present disclosure. As shown in FIG. 3, the electroluminescent display panel 300 of the second embodiment of the present disclosure further comprise a multiplexer 230 configured to control conduction state between the data driving unit 220 and the first and second data lines D1, D2.

Figure 4:
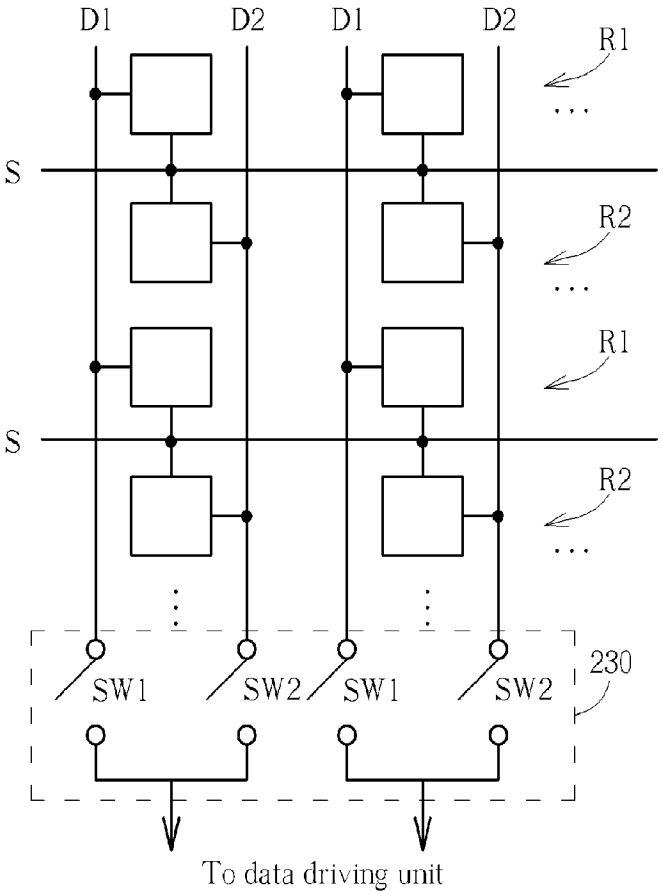
FIG. 4 is a diagram showing a first embodiment of a multiplexer in FIG. 3.
Figure 5:
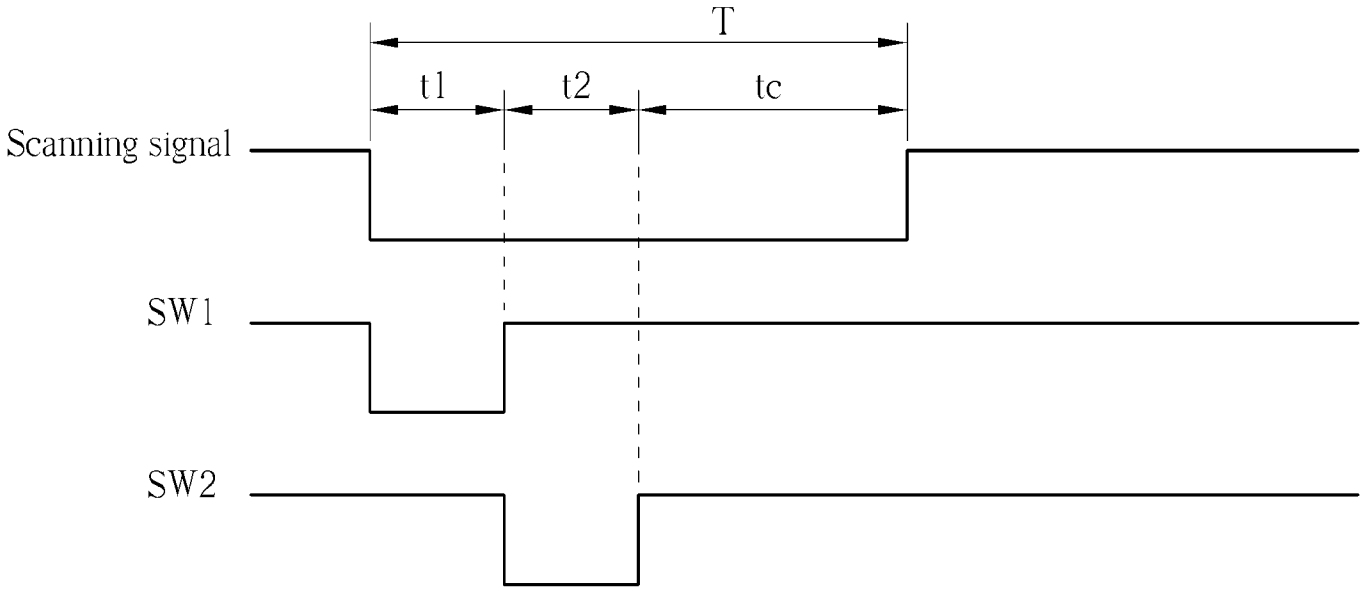
FIG. 5 is a diagram showing on and off states of switches of the multiplexer in FIG. 4.

Please refer to FIG. 4 and FIG. 5 together, and refer to FIG. 3 as well. FIG. 4 is a diagram showing a first embodiment of a multiplexer in FIG. 3. FIG. 5 is a diagram showing driving waveform for controlling the on and off states of switches of the multiplexer in FIG. 4. As shown in figures, the multiplexer 230 comprises a plurality of first switches SW1 and a plurality of second switches SW2. The plurality of first switches are respectively coupled between pins of the data driving unit 220 and the corresponding first data lines D1. The plurality of second switches SW2 are respectively coupled between pins of the data driving unit 220 and the corresponding second data lines D2. The multiplexer 230 conducts the first switches SW1 (turns on the first switches SW1) during a first enable period t1 of a scanning period T of each of the scan lines, conducts the second switches SW2 (turns on the second switches SW2) during a second enable period t2 of the scanning period T, and disconnects the data driving unit 220 from the data lines D1, D2 (turns off the first and second switches SW1, SW2) during a disable period tc of the scanning period T. The first enable period t1, the second enable period t2 and the disable period tc are different from each other, and the disable period is subsequent to the first enable period t1 and the second enable period t2. Each of the first enable period t1 and the second enable period t2 is not shorter than a charging time of each of the sub-pixels. The charging time is usually known as 17 us. In addition, the disable period tc is preferred to be a half of the scanning period T. On the other hand, in other embodiments of the present disclosure, the scanning period T may not comprise the disable period tc.

According to the above arrangement, when the first switches SW1 are turned off after the first enable period t1, since parasitic capacitance of the first data lines D1 is several times of capacitance of the capacitor of the sub-pixel, the first data lines D1 can keep charging the capacitors of the sub-pixels even though the first switches SW1 are turned off. Similarly, when the second switches SW2 are turned off after the second enable period t2, since parasitic capacitance of the second data lines D2 is several times of capacitance of the capacitor of the sub-pixel, the second data lines D2 can keep charging the capacitors of the sub-pixels even though the second switches SW2 are turned off. Therefore, turned-on sub-pixels have enough time for charging, in order to achieve correct image brightness.

Figure 6:
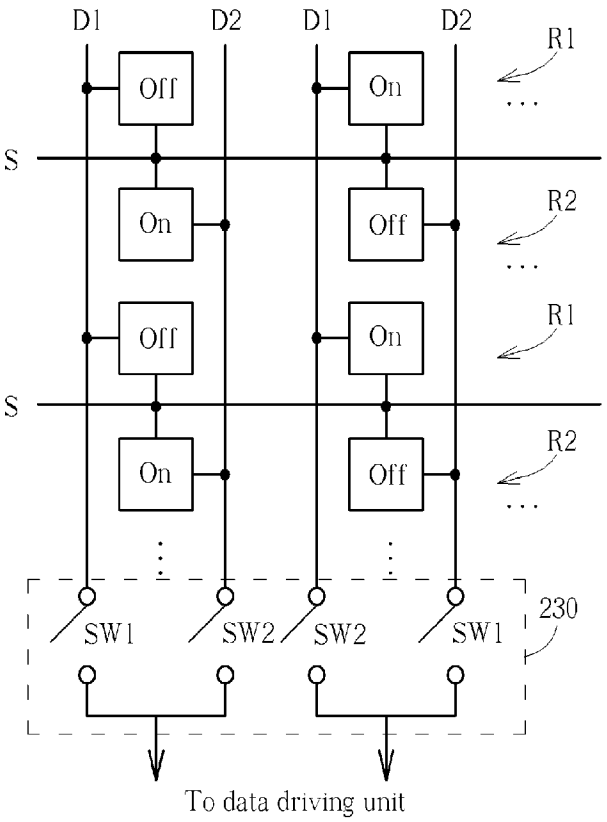
FIG. 6 is a diagram showing a second embodiment of the multiplexer in FIG. 3.

Please refer to FIG. 6, and refer to FIG. 3 and FIG. 5 as well. FIG. 6 is a diagram showing a second embodiment of the multiplexer in FIG. 3. On and off states of switches of the multiplexer in FIG. 6 are also shown in FIG. 5. As shown in figures, the first switches SW1 and second switches SW2 of the multiplexer 230 are respectively and interlacedly coupled between pins of the data driving unit 220 and the first or second data lines D1, D2. Similarly, the multiplexer 230 conducts the first switches SW1 (turns on the first switches SW1) during the first enable period t1 of the scanning period T of each of the scan lines, conducts the second switches SW2 (turns on the second switches SW2) during the second enable period t2 of the scanning period T, and disconnects the data driving unit 220 from the data lines D1, D2 (turns off the first and second switches SW1, SW2) during the disable period tc of the scanning period T.

According to the above arrangement, the multiplexer in FIG. 6 not only can achieve a result similar to that of the multiplexer in FIG. 4, but also can interlacedly turn on the first rows of sub-pixels and the second rows of the sub-pixels, in order to solve flicker problems.

Figure 7:
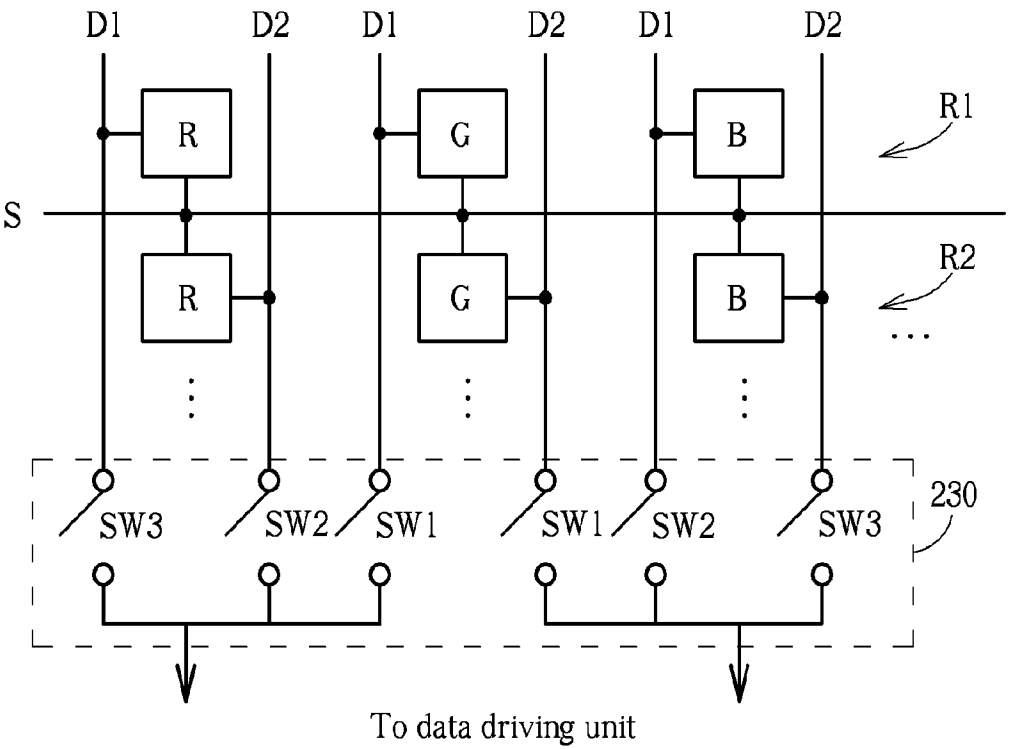
FIG. 7 is a diagram showing a third embodiment of the multiplexer in FIG. 3.
Figure 8:
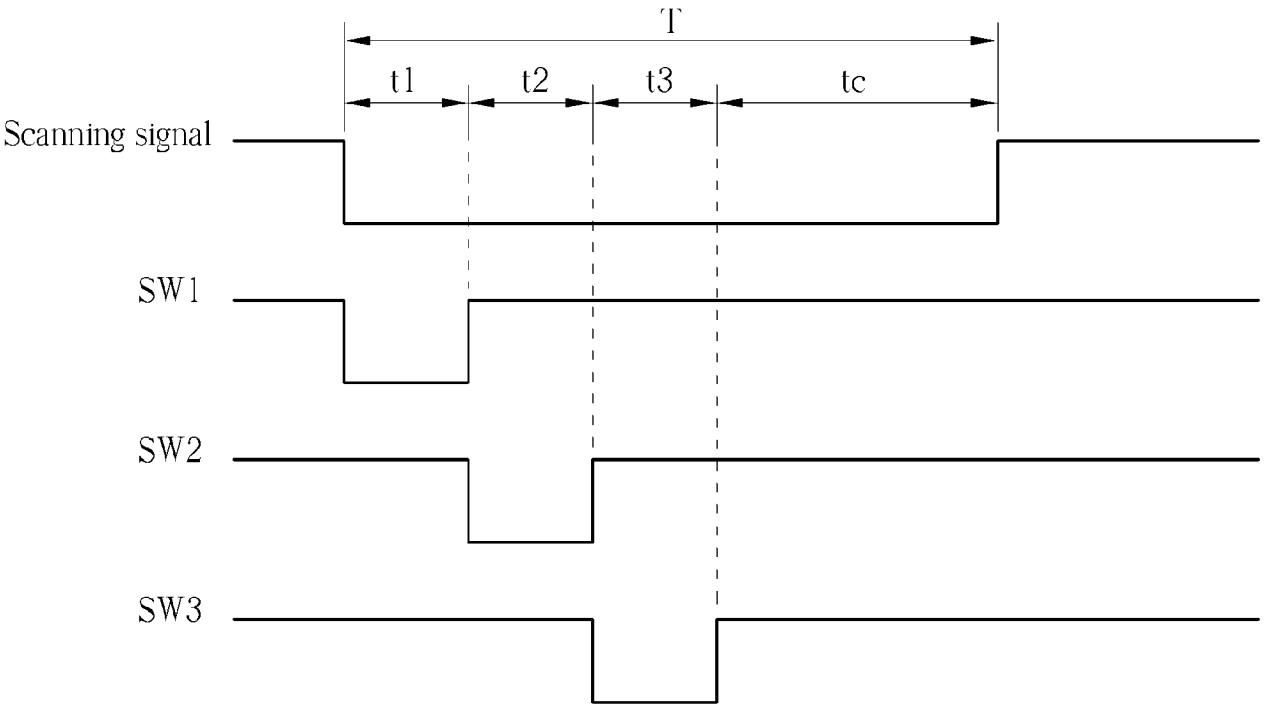
FIG. 8 is a diagram showing on and off states of switches of the multiplexer in FIG. 7.

Please refer to FIG. 7 and FIG. 8 together, and refer to FIG. 3 as well. FIG. 7 is a diagram showing a third embodiment of the multiplexer in FIG. 3. FIG. 8 is a diagram showing on and off states of switches of the multiplexer in FIG. 7. Arrangement of sub-pixels R, G, B is shown in FIG. 7. The electroluminescent display panel comprises a plurality of sub-pixels, such as green sub-pixels G, red sub-pixels R, and blue sub-pixels B. Wherein one of any three adjacent columns of sub-pixels is a column of green sub-pixels, and the columns of green sub-pixels are not next to each other. As shown in FIG. 7, the first column of sub-pixels is a column of red sub-pixels R, the second column of sub-pixels is a column of green sub-pixels G, and the third column of sub-pixels is a column of blue sub-pixels B. The multiplexer 230 comprises a plurality of first switches SW1, a plurality of second switches SW2, and a plurality of third switches SW3. Each of the first switches SW1 is coupled to one of a first data line D1 and a second data line D2 corresponding to the column of green sub-pixels G. The second switches SW2 are respectively coupled to a second data line D2 corresponding to the column of red sub-pixels R and a first data line D1 corresponding to the column of blue sub-pixels B. The third switches SW3 are respectively coupled to a first data line D1 corresponding to the column of red sub-pixels R and a second data line D2 corresponding to the column of blue sub-pixels B. The multiplexer 230 conducts the first switches SW1 (turns on the first switches SW1) during a first enable period t1 of a scanning period T of each of the scan lines, conducts the second switches SW2 (turns on the second switches SW2) during a second enable period t2 of the scanning period T, and conducts the third switches SW3

(turns on the third switches SW3) during a third enable period t3 of the scanning period T.

According to the above arrangement in FIG. 7 and FIG. 8, the green sub-pixels G are charged longer than the red and blue sub-pixels R, B. Since human eyes are more sensitive to the green color, the embodiment of FIG. 7 can further reduce the mura effect. In addition, in the embodiment of FIG. 7, positions of the red sub-pixels R and the blue sub-pixels B can be interchanged, that is, the second switches SW2 are respectively coupled to first data line D1 corresponding to the column of red sub-pixels R and the second data line D2 corresponding to the column of blue sub-pixels B, and the third switches SW3 are respectively coupled to the second data line D2 corresponding to the column of red sub-pixels R and the first data line D1 corresponding to the column of blue sub-pixels B.

Figure 9:
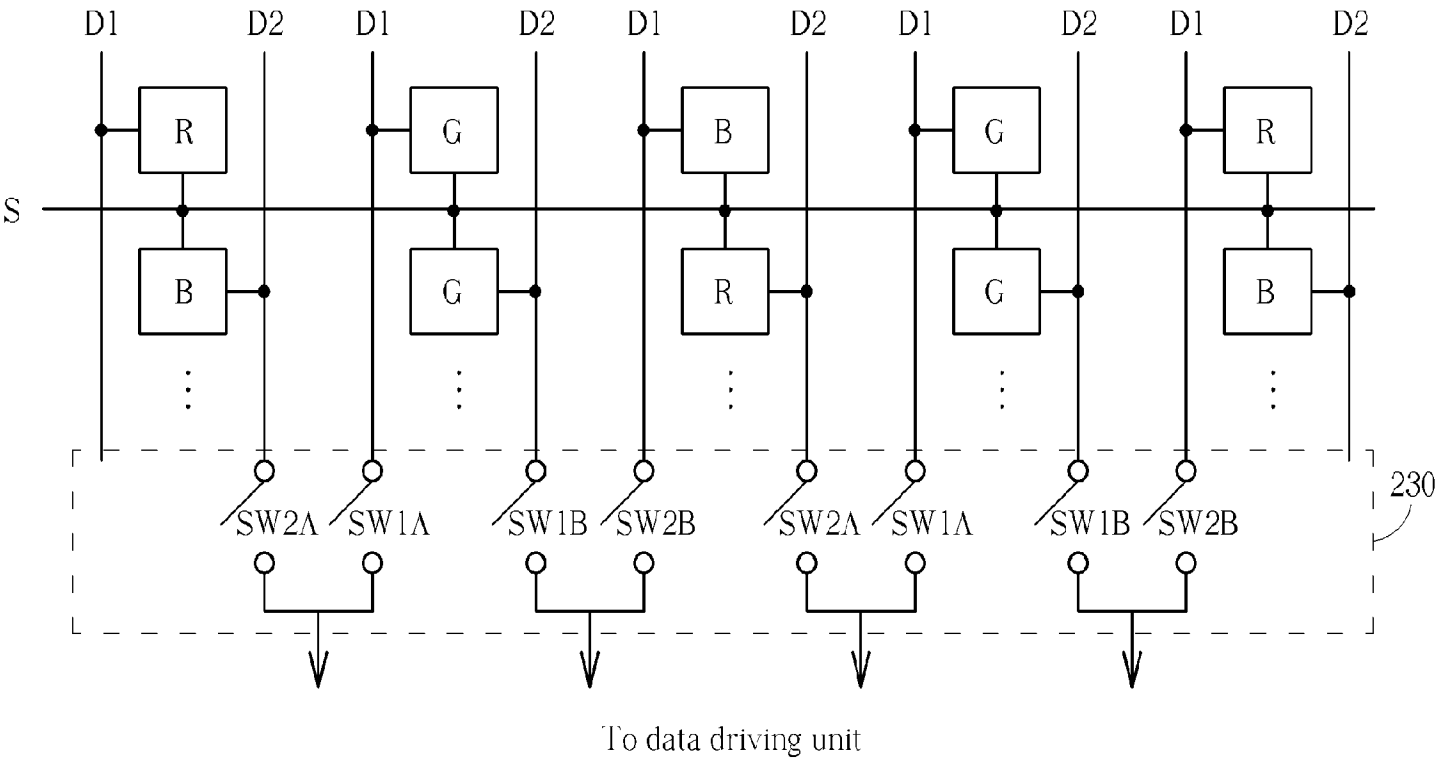
FIG. 9 is a diagram showing a fourth embodiment of the multiplexer in FIG. 3.
Figure 10:
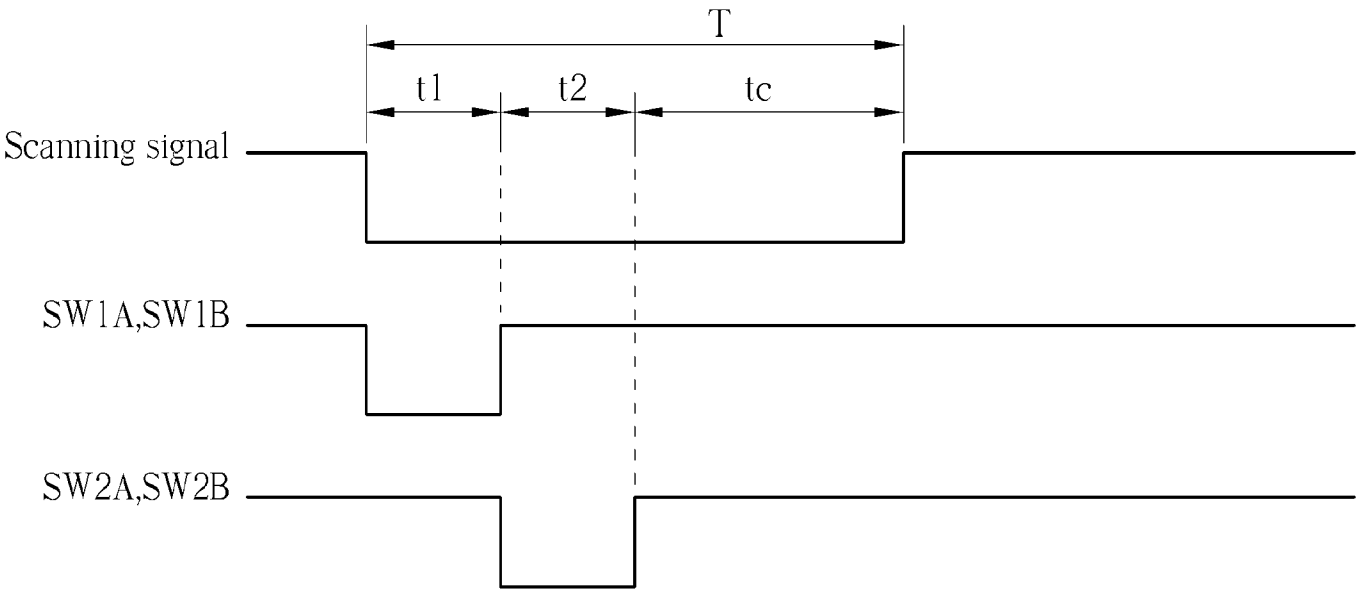
FIG. 10 is a diagram showing on and off states of switches of the multiplexer in FIG. 9.

Please refer to FIG. 9 and FIG. 10 together, and refer to FIG. 3 as well. FIG. 9 is a diagram showing a fourth embodiment of the multiplexer in FIG. 3. The present disclosure is not limited to the above sub-pixel arrangement. The present disclosure can achieve a same result by using different sub-pixel arrangements with the multiplexer. FIG. 10 is a diagram showing on and off states of switches of the multiplexer in FIG. 9. Arrangement of sub-pixels R, G, B is shown in FIG. 9. The electroluminescent display panel comprises a plurality of sub-pixels, such as green sub-pixels G, red sub-pixels R, and blue sub-pixels B. Wherein one of any two adjacent columns of sub-pixels is a column of green sub-pixels, and the columns of green sub-pixels are not next to each other. The other column of sub-pixels adjacent to the column of green sub-pixels comprises red sub-pixels R and blue sub-pixels B arranged interlacedly. As shown in FIG. 9, the first column of sub-pixels comprises red sub-pixels R and blue sub-pixels B arranged interlacedly, the second column of sub-pixels is a column of green sub-pixels G, and sub-pixel arrangement of the third column of sub-pixels is opposite to sub-pixel arrangement of the first column of sub-pixels. The multiplexer 230 comprises a plurality of first switch sets, and a plurality of second switch sets. The first switch sets comprise a first set of first switches SW1A and a second set of first switches SW1B. The second switch sets comprise a first set of second switches SW2A and a second set of second switches SW2B. The first set of first switches SW1A are respectively coupled to first data lines D1 of corresponding columns of green sub-pixels G, and the second set of first switches SW1B are coupled to second data lines D2 of corresponding columns of green sub-pixels G. The first set of second switches SW2A are respectively coupled to second data lines D2 of corresponding columns of sub-pixels adjacent to the first data lines D1 of the columns of green sub-pixels G (columns of sub-pixels at left sides of the columns of green sub-pixels G), and the second set of second switches are respectively coupled to first data lines of corresponding columns of sub-pixels adjacent to the second data lines of the columns of green sub-pixels (columns of sub-pixels at right sides of the columns of green sub-pixels G). The multiplexer 230 conducts (turns on) the first set of first switches SW1A and second set of first switches SW1B during a first enable period t1 of a scanning period T of each of the scan lines, and conducts (turns on) the first set of second switches SW2A and second set of second switches SW2B during a second enable period t2 of the scanning period T.

According to the above arrangement in FIG. 9 and FIG. 10, the columns of green sub-pixels G are coupled to corresponding first switches SW1A, SW1B, such that the green sub-pixels G are charged longer than the red and blue sub-pixels R, B. Since human eyes are more sensitive to the green color than to the red and blue colors, according to sub-pixel arrangement with the multiplexer of the present disclosure, the embodiment of FIG. 9 not only can reduce the mura effect, but also can increase sensitivity to the display panel for human eyes.

Figure 11:
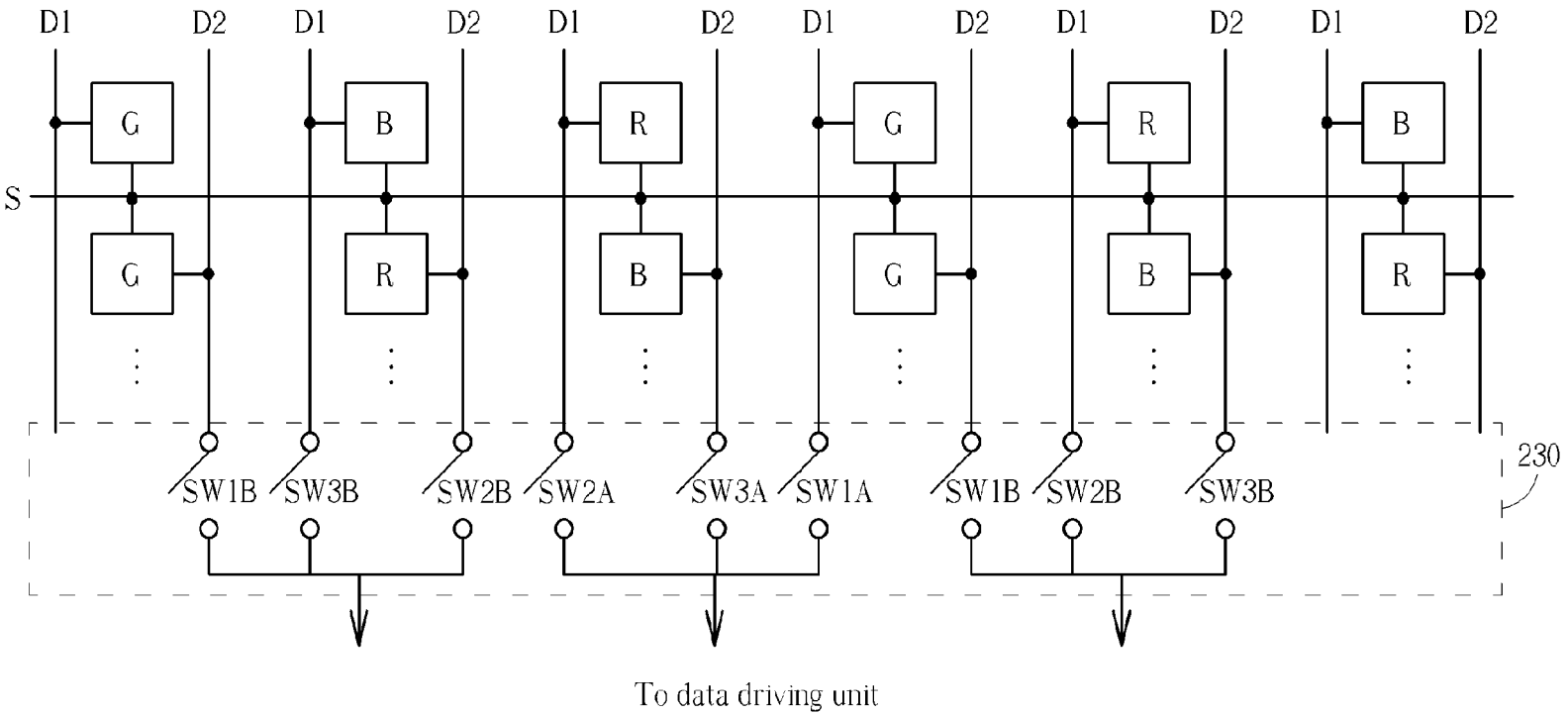
FIG. 11 is a diagram showing a fifth embodiment of the multiplexer in FIG. 3.
Figure 12:
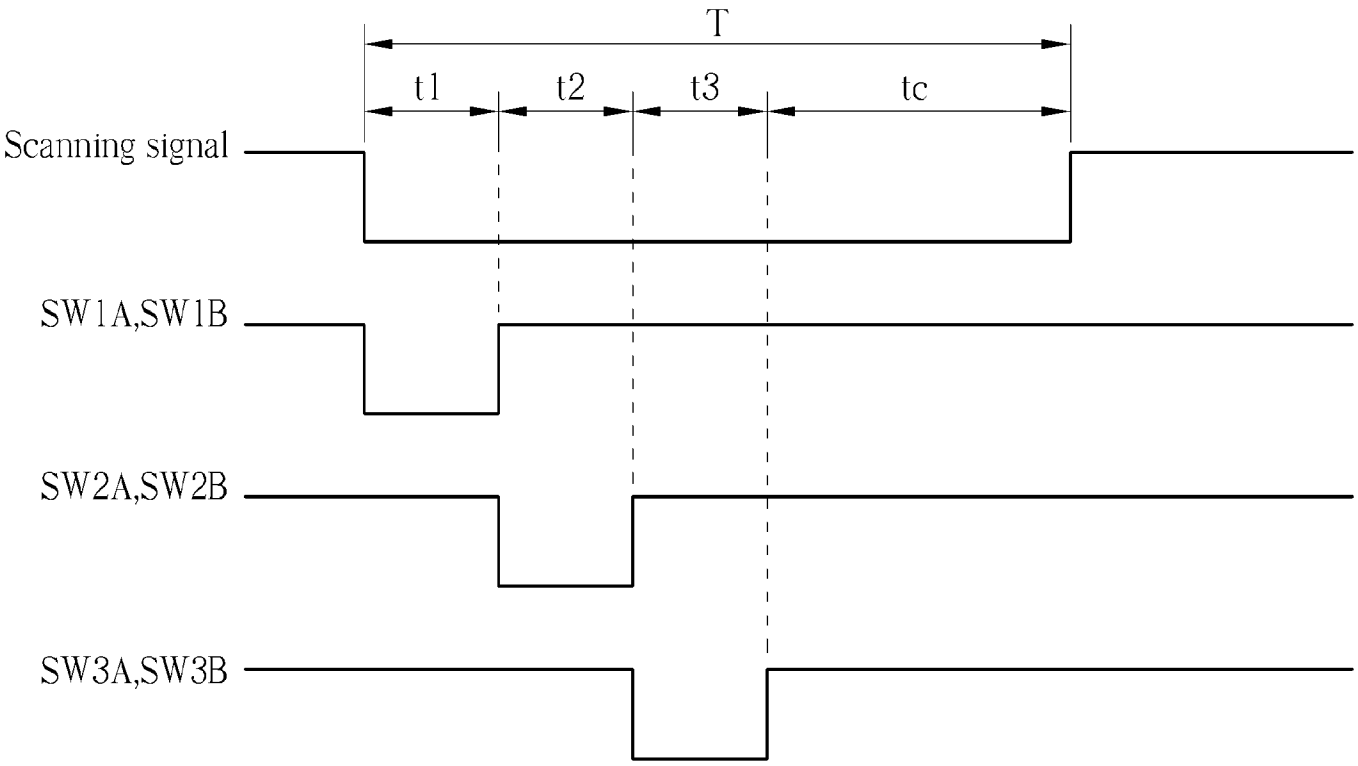
FIG. 12 is a diagram showing on and off states of switches of the multiplexer in FIG. 11.

Please refer to FIG. 11 and FIG. 12 together, and refer to FIG. 3 as well. FIG. 11 is a diagram showing a fifth embodiment of the multiplexer in FIG. 3. FIG. 12 is a diagram showing on and off states of switches of the multiplexer in FIG. 11. Arrangement of sub-pixels R, G, B is shown in FIG. 11. One of any three adjacent columns of sub-pixels is a column of green sub-pixels, and the columns of green sub-pixels are not next to each other. Another column of sub-pixels comprises red sub-pixels R and blue sub-pixels B arranged interlacedly, and has sub-pixel arrangement opposite to sub-pixel arrangement of a rest column of sub-pixels. As shown in FIG. 11, the first column of sub-pixels is a column of green sub-pixels G, the second column of sub-pixels comprises red sub-pixels R and blue sub-pixels B arranged interlacedly, and sub-pixel arrangement of the third column of sub-pixels is opposite to sub-pixel arrangement of the second column of sub-pixels. The multiplexer 230 comprises a plurality of first switch sets, a plurality of second switch sets, and plurality of third switch sets. The first switch sets comprise a first set of first switches SW1A and a second set of first switches SW1B. The second switch sets comprise a first set of second switches SW2A and a second set of second switches SW2B. The third switch sets comprise a first set of third switches SW3A and a second set of third switches SW3B. The first set of first switches Sw1A are respectively coupled to first data lines D1 of corresponding columns of green sub-pixels G, and the second set of first switches SW1B are respectively coupled to second data lines D2 of corresponding columns of green sub-pixels G. The first set of second switches SW2A are respectively coupled to first data lines D1 of corresponding columns of sub-pixels adjacent to the first data lines D1 of the columns of green sub-pixels G (columns of sub-pixels at left sides of the columns of green sub-pixels G), and the first set of third switches SW3A are respectively coupled to second data lines D2 of corresponding columns of sub-pixels adjacent to the first data lines of the columns of green sub-pixels G. The second set of second switches SW2B are respectively coupled to first data lines D1 of corresponding columns of sub-pixels adjacent to the second data lines D2 of the columns of green sub-pixels G (columns of sub-pixels at right sides of the columns of green sub-pixels G), and the second set of third switches SW3B are respectively coupled to second data lines D2 of corresponding columns of sub-pixels adjacent to the second data lines D2 of the columns of green sub-pixels G. The multiplexer 230 conducts (turns on) the first set of first switches SW1A and second set of first switches SW1B during a first enable period t1 of a scanning period T of each of the scan lines, conducts (turns on) the first set of second switches SW2A and second set of second switches SW2B during a second enable period t2 of the scanning period T, and conducts (turns on) the first set of third switches SW3A and second set of third switches SW3B during a third enable period t3 of the scanning period T.

Similarly, according to the above arrangement in FIG. 11 and FIG. 12, the green sub-pixels G are charged longer than the red and blue sub-pixels R, B. Since human eyes are more sensitive to the green color than to the red and blue colors, according to sub-pixel arrangement with the multiplexer of the present disclosure, the embodiment of FIG. 11 can also further reduce the mura effect.

Figure 13:
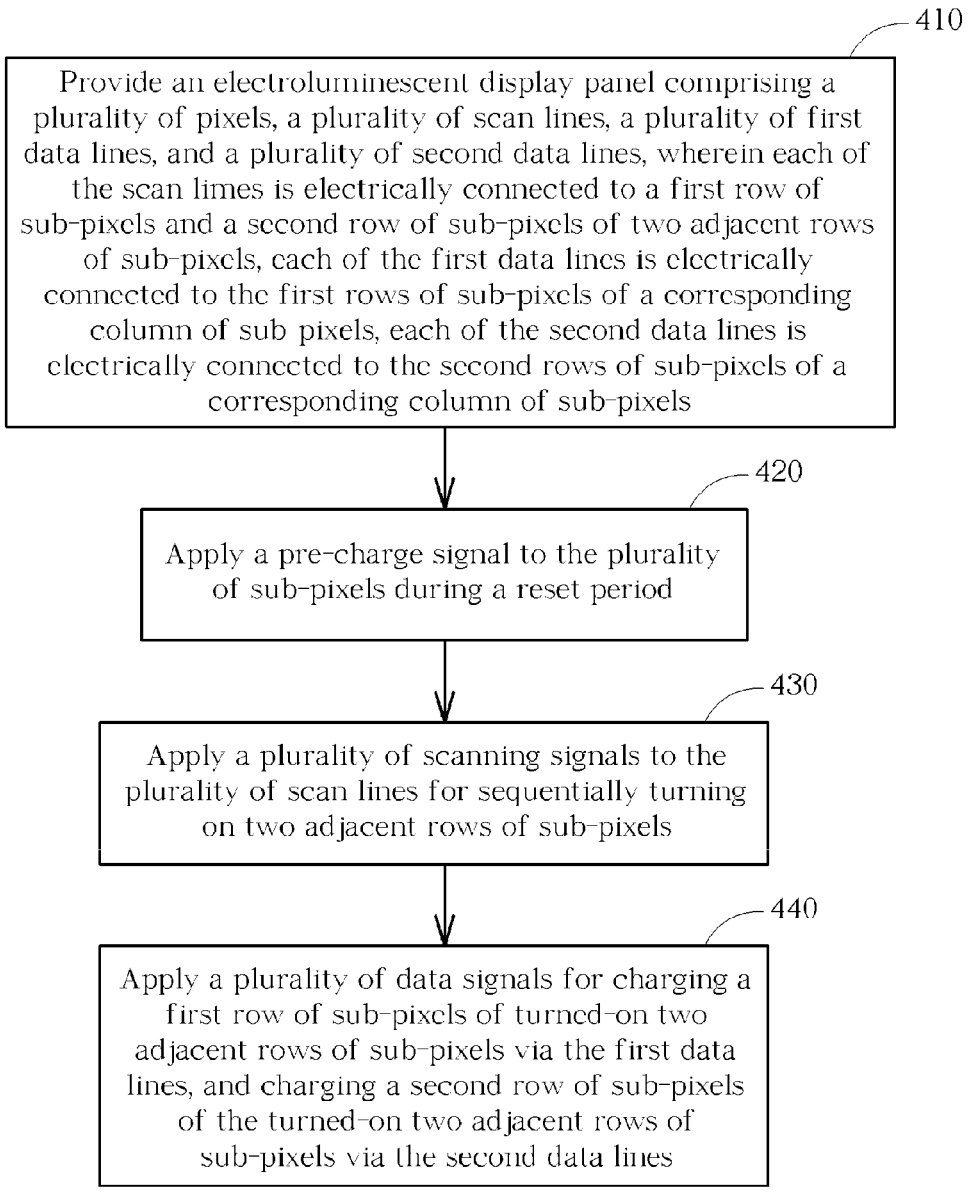
FIG. 13 is a flowchart showing a driving method of the electroluminescent display panel of the present disclosure.

Please refer to FIG. 13. FIG. 13 is a flowchart 400 showing a driving method of the electroluminescent display panel of the present disclosure. The flowchart of driving method of the electroluminescent display panel of the present disclosure comprises the following steps:

Step 410: Provide an electroluminescent display panel comprising a plurality of pixels, a plurality of scan lines, a plurality of first data lines, and a plurality of second data lines, wherein each of the pixels comprises a plurality of sub-pixels, each of the scan lines is electrically connected to a first row of sub-pixels and a second row of sub-pixels of two adjacent rows of sub-pixels, each of the first data lines is electrically connected to the first rows of sub-pixels of a corresponding column of sub-pixels, each of the second data lines is electrically connected to the second rows of sub-pixels of a corresponding column of sub-pixels;

Step 420: Apply a pre-charge signal to the plurality of sub-pixels during a reset period;

Step 430: Apply a plurality of scanning signals to the plurality of scan lines for sequentially turning on two adjacent rows of sub-pixels; and Step 440: Apply a plurality of data signals for charging a first row of sub-pixels of turned-on two adjacent rows of sub-pixels via the first data lines, and charging a second row of sub-pixels of the turned-on two adjacent rows of sub-pixels via the second data lines.

Figure 14:
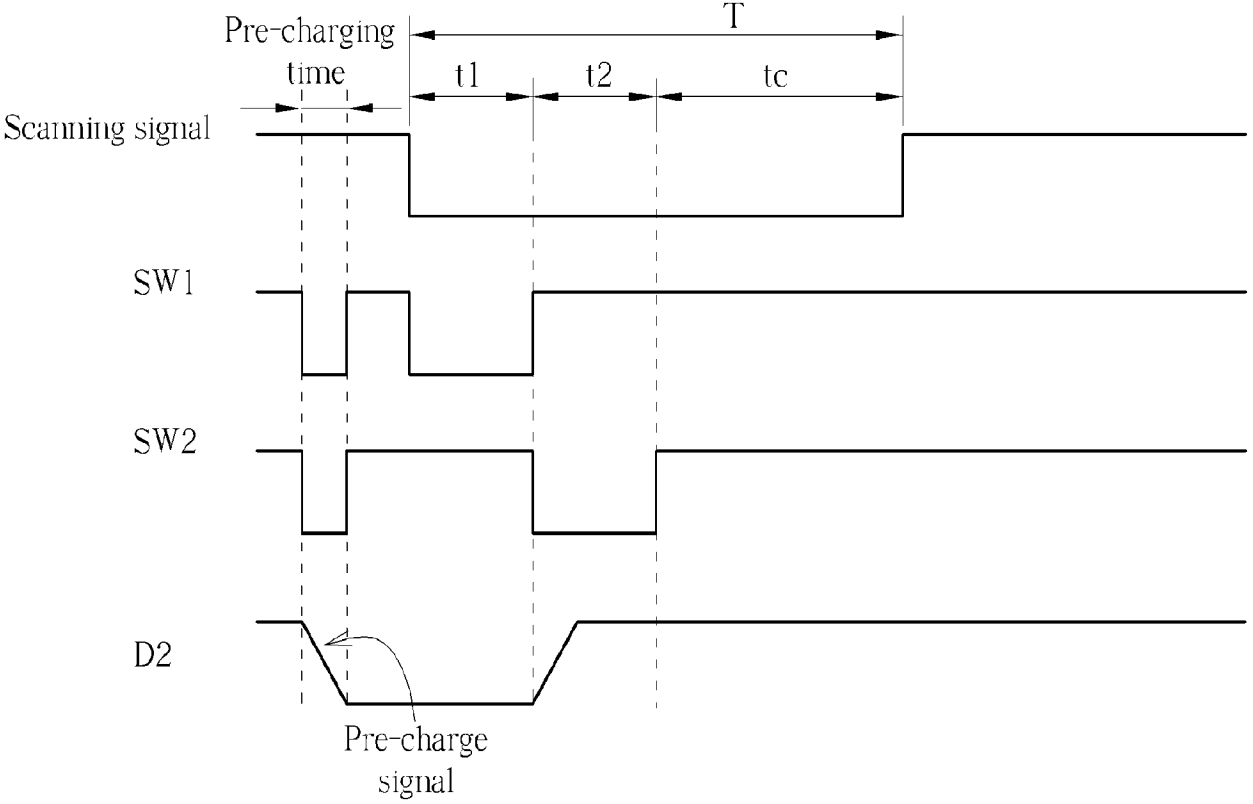
FIG. 14 is a diagram showing another embodiment of on and off states of switches of the multiplexer in FIG. 4.

In addition, please refer to FIG. 14. FIG. 14 is a diagram showing another embodiment of on and off states of switches of the multiplexer in FIG. 4. As shown in FIG. 14, the first switches SW1 and the second switches SW2 are turned on during a reset period before the scanning period T, and a pre-charge signal is applied to the sub-pixels via the second data lines D2 to reset the voltage of D2 to a predetermined value, such that the second row R2 of sub-pixels of the turned-on two adjacent rows of sub-pixels can be charged by the data signals correctly during the second enable period t2. By applying the pre-charge signal to the sub-pixels through the data lines, the sub-pixels may be received data voltage correctly without influence by rest electric charges stored on the data lines.

Pixel design of the electroluminescent display panel of the present disclosure is capable of charging two adjacent rows of sub-pixels within a scanning period by arrangement of double data lines as shown in the above embodiments. The first rows of sub-pixels are charged when the first data line is conducted, and the second rows of sub-pixels are charged when the second data line is conducted. The first data line still can keep charging the first rows of sub-pixels by residual electricity even though the first data line is not conducted, such that time for charging the sub-pixels can be increased, for allowing the sub-pixels achieving correct brightness. In addition, the multiplexer of the electroluminescent display panel of the present disclosure is capable of controlling charging sequence of the sub-pixels by utilizing the multiplexer to conduct the data lines in a predetermined sequence, in order to charge each row of sub-pixels for a same charging time, and further reduce the mura effect.

Those skilled in the art will readily observe that numerous modifications and alterations of the device and method may be made while retaining the teachings of the invention. Accordingly, the above disclosure should be construed as limited only by the metes and bounds of the appended claims.

The invention claimed is:

1. An electroluminescent display panel, comprising:

a plurality of sub-pixels arranged in rows, the sub-pixels comprising red sub-pixels, green sub-pixels, and blue sub-pixels; and a plurality of multiplexers electrically connected to the plurality of sub-pixels, wherein each of the plurality of multiplexers is configured to control at least one of the green sub-pixels, wherein adjacent ones of the green sub-pixels are electrically connected to different ones of the multiplexers, wherein each of the multiplexers has a plurality of switches, wherein, for each of the multiplexers, a first switch of the plurality of switches is configured to control a corresponding one of the green sub-pixels in a first of the rows, a second switch of the plurality of switches is configured to control a corresponding one of the sub-pixels in the first of the rows, and a third switch of the plurality of switches is configured to control a corresponding one of the sub-pixels in a second of the rows, and wherein, for each scanning period, each of the plurality of multiplexers is configured to activate the first switch to turn on the corresponding one of the green sub-pixels in the first of the rows first from among the sub-pixels electrically connected thereto, then activate the second switch to turn on the corresponding one of the sub-pixels in the first of the rows, then activate the third switch to turn on the corresponding one of the sub-pixels in the second of the rows.

2. The display panel of claim 1, wherein each of the adjacent ones of the green sub-pixels is arranged in a corresponding row.

3. The display panel of claim 1, wherein the multiplexers are configured to charge the green sub-pixels for longer periods than the charging periods associated with the red sub-pixels and the blue sub-pixels.

4. The display panel of claim 1, wherein each of the multiplexers is configured to control at least one of the red sub-pixels or at least one of the blue sub-pixels.

5. The display panel of claim 1, further comprising:

a plurality of scan lines, each of the scan lines being electrically connected to the first row of the sub-pixels and the second row of the sub-pixels;

a plurality of first data lines, each of the first data lines being electrically connected to a corresponding column of the sub-pixels; and a plurality of second data lines, each of the second data lines being electrically connected to a corresponding column of the sub-pixels.

6. The display panel of claim 5, further comprising:

a scan driving unit, having scan circuitry, coupled to the plurality of scan lines configured to output a plurality of scanning signals; and a data driving unit, having driving circuitry, coupled to the first data lines and the second data lines configured to output a plurality of data signals.

7. The display panel of claim 1, wherein the first of the rows and the second of the rows are adjacent to each other.

8. The display panel of claim 1, wherein each of the multiplexers is configured to control one of the red sub-pixels, one of the blue sub-pixels and one of the green sub-pixels.

9. The display panel of claim 1, wherein:

the plurality of sub-pixels are additionally arranged in columns; and the adjacent ones of the green sub-pixels are arranged in a first of the columns.

10. The display panel of claim 9, wherein at least one of the red sub-pixels and at least one of the blue sub-pixels are arranged in a second of the columns.

11. The display panel of claim 10, wherein the first of the columns and the second of the columns are adjacent to each other.

12. The display panel of claim 10, wherein the red sub-pixels and the blue sub-pixels of the second of the columns are arranged in an alternating pattern.

13. The display panel of claim 10, wherein the multiplexers are configured to charge the green sub-pixels for longer periods than the charging periods associated with the red sub-pixels and the blue sub-pixels.

14. The display panel of claim 10, further comprising:

a first scan line electrically connected to the first of the rows and to the second of the rows;

a first data line electrically connected to the first of the columns; and a second data line electrically connected to the second of the columns.

* * * * *